US005490339A

United States Patent [19]

Accettola

[11] Patent Number: 5,490,339

[45] Date of Patent: Feb. 13, 1996

[54] TRENCHING SYSTEM FOR EARTH SURFACE USE, AS ON PAVED STREETS, ROADS, HIGHWAYS AND THE LIKE

[76] Inventor: Frank J. Accettola, 9006 Steele Rd., Napa, Calif. 94558

[21] Appl. No.: 252,768

[22] Filed: Jun. 2, 1994

[51] Int. Cl.[6] ..... E02F 5/08

[52] U.S. Cl. ..... 37/94; 37/91; 299/39.2; 299/64

[58] Field of Search ..... 37/91, 92, 93, 37/94, 95, 96, 97, 189, 190; 198/315, 316.1, 318; 299/39, 64

[56] References Cited

U.S. PATENT DOCUMENTS

| | | | |
|---|---|---|---|
| 4,069,605 | 1/1978 | Satterwhite | 37/91 X |
| 4,193,636 | 3/1980 | Jakob | 299/39 |
| 4,678,236 | 7/1987 | Wirtgen | 299/39 X |
| 5,009,548 | 4/1991 | Falbo et al. | 198/316.1 X |
| 5,078,540 | 6/1991 | Jakob et al. | 299/39 X |
| 5,219,380 | 6/1993 | Young et al. | 198/315 X |
| 5,315,770 | 5/1994 | Campbell | 37/91 X |

*Primary Examiner*—Henry E. Raduazo
*Assistant Examiner*—Robert Pezzuto
*Attorney, Agent, or Firm*—Harold D. Messner

[57] ABSTRACT

The present invention relates to a center-line trenching system for use at the earth's surface such as on a paved street, road, highway or the like. The system includes a rubber tired drive machine movable over the earth's surface for advancing a side-by-side tandem of a earth saw and a conveyor attached to a rear surface of the drive machine. The conveyor includes a subframe and an elongated main frame. The subframe comprises a pair of longitudinally extending truss members pivotly attached to the drive machine at a first pivot axis of rotation that is fixed in elevation relative to the earth's surface. The main frame includes a pair of rail members pivotally mounted at near end regions to the truss members at a second axis of rotation, and has trailing end regions that define the remote termini of the conveyor. A hydrostatic actuator is pivotally mounted between the subframe and the main frame. An on-site wheel subassembly pivotally attached to the subframe having a pair of swivel wheels in rolling contact with the earth's surface during an active state of the conveyor and in an up-folded position well above the earth's surface during a trailering state of the conveyor, completes the assembly. Mounted to the rail members of the main frame is a pair of rubber tired, trailering wheels for the purpose of trailering the conveyer to a job site during the trailering state of use of the conveyor but positionable above the earth's surface during the active state of the conveyor.

23 Claims, 7 Drawing Sheets

TRENCHING SYSTEM FOR EARTH SURFACE USE, AS ON PAVED STREETS, ROADS, HIGHWAYS AND THE LIKE

SCOPE OF THE INVENTION

The present invention relates to trenching systems used at the earth's surface, as on paved streets, roads, highways or the like in which a powerful drive machine that is rubber tired is employed in conjunction with a trencher in side-by-side association with a rubber wheeled conveyer, the conveyer in turn receiving debris from the trencher and transporting the same to a following conventional dump truck, and more particularly to a center-line trenching system in which the transverse width W1 of the associated trencher and conveyer is at least equal to or less than the transverse width W1 of the drive machine attached to the trencher and conveyer.

BACKGROUND OF THE INVENTION

There are a multiplicity of reasons for providing a trench in a paved roadway such as a city street, road, highway or the like. The provision for water lines, cable television lines, telephone lines, mounting reflectors, adding road supports, are just a few of the reasons a trench may be necessary. However, with the crowding of roadways as the trenching operation occur, some licensing authorities have issued contracts that limit trenching systems to the use of single lane of roadway, with the remaining lane (s) to be open to vehicular traffic, In addition, the operations are to proceed as fast as possible, with fast clean-up of debris required. Set-up time to begin each work day, as a result have become an important cost factor since in many instances the trenching equipment must be trailered back to a off-site storage location as the conclusion of the work day.

Under these circumstances, trenching systems have included the use of adjuncts to the cutting saw to aid in the daily clean-up operations, such as compressed air and water as shown in U.S. Pat. No. 4,900,094 and/or the use of additional clean-up equipment such as manual labor, as contemplated in U.S. Pat. No. 4,640,551. Under both of these occasions, there is a need for a large work crew to clean the paved roadway and remove the debris dislodged from the roadway.

While I am aware of side-by-side conveyors for use with such trenchers including single disc and multiple disc saws, such conveyors of which I am aware are difficult to set-up on a daily, reoccurring basis, present difficulties in off-loading the debris to a waiting dump truck especially where only one lane is available for such operations, are clumsy in operations especially if the trench is not a straight line from start to finish point and require a rather large clean-up crew.

SUMMARY OF THE INVENTION

The present invention relates to a center-line trenching system for use at the earth's surface such as on a paved street, road, highway or the like. The system includes a rubber tired drive machine of transverse width W1 movable over the earth's surface for advancing a side-by-side tandem of a earth saw and a conveyor of transverse width W2 attached to a rear surface of the drive machine. The drive machine also includes an internal combustion engine driving a series of hydrostatic pumps, one or more of which are used to drive external components aboard the the earth saw and conveyor attached to the drive machine. The earth saw includes a cutting disc having cutting protuberances circumferentially spaced about its periphery and adjustable at different depths within the earth formation below the earth's surface. The cut groove that results defines a longitudinal working plane normal to the earth's surface. A shroud is positioned over an upper sector of the cutting disc and includes an opening located to one side of the working plane. A lower segment of the shroud cooperates with the motion of the cutting disc to collect and convey the debris cut from the earth formation, to the side opening of the shroud and thence to the conveyor of the invention. The conveyer is attached to the drive machine using a novel pivot hitch positionally fixed in elevation relative to the earth's surface, such hitch being bisected by a second longitudinal working plane parallel to the first working plane which also passing through the drive machine. A male element of the pivot hitch in the shape of the letter "T", has a base leg the attachably slides into a female receiver welded to the rear mounting surface of the drive machine. On the other hand, transverse legs of the pivot hitch, cantilever from the base leg for pivotal attachment within a pair of female stubs attached to the forward end of the conveyor. Such pivotal attachment of the male and female elements define a first axis of rotation that is positionally fixed in elevation but is normal to both working planes for the conveyor.

The conveyor also includes a subframe and an elongated main frame. The subframe comprises a pair of longitudinally extending truss members. The main frame includes a pair of rail members pivotally mounted at near end regions to the truss members of the subframe at a second axis of rotation, and has trailing end regions that define the remote termini of the conveyor. A hydrostatic actuator is pivotally mounted between the subframe and the main frame. An on-site wheel subassembly pivotally attached to the subframe having a pair of swivel wheels in rolling contact with said earth's surface during an active state of the conveyor and an up-folded position well above the earth's surface during a trailering state of the conveyor, completes the assembly. Mounted to the rail members of the main frame is a pair of rubber tired, trailering wheels for the purpose of trailering the conveyer to a job site during the trailering state of use of the conveyor but positionable above the earth's surface during the active state of the conveyor.

The hydrostatic actuator is operatively attached to one of the exteriorly positioned hydrostatic pumps aboard the drive machine through a control unit to perform two major functions:

(i) to provide a linear force to the main frame to permit the latter to be tilted about the second axis of rotation to provide a ramped position upsloped from its near end regions. As a result, the rubber tired wheels used in the trailering function of the invention, are elevated off the earth's surface. Similarly, the aforementioned linear force also permits relocation of the swivelable wheels of said on-site wheel subassembly from their up-folded trailering position into rolling contact with the earth's surface and (ii) in the active state of the conveyor, to relocate the trailing end regions of said rail members of the main frame to a working sloped position whereby the trailing end regions of the main frame are positioned at a pre-selected height relative to the earth's surface to permit debris exiting from the earth saw to be off-loaded in a minimum transverse space.

The positions of the on-site wheel subassembly, the subframe and the main frame are thus variable:

(i) in the trailering mode, the main frame and subframe are placed in broad longitudinal contact relative to each other with a portion of the main frame cantilevering from the subframe wherein the one-site wheel subassembly is stowed above the earth's surface, (ii) at the job site, the swivel wheels of the on-site wheel subassembly are released from their stowed position. Then the hydrostatic actuator is activated wherein :its piston elongates and first causes the subframe to be lowered into contact with the earth's surface to form a reaction fulcrum therebetween, and secondly, causes the main frame to assume the aforementioned upsloped position above the earth's surface. During the establishment of its upsloped position, the main frame pivots about the pivot axis formed between it and the subframe. When the trailing end of the main frame attains a pre-selected height above the earth's surface, a chain is attached between the main frame and the drive machine to anchor the main frame in the up-sloped position. Then the hydrostatic actuator is deactivated which causes the subframe, on-site wheel subassembly and hydrostatic actuator to assume an up-sloped position below the main frame whereupon the swivel wheels are relocated into an overcenter position relative to their pivot axes so subsequent activation of the hydrostatic actuator places them in rolling contact with the earth's surface. Further activation of the hydrostatic actuator, causes the main frame to assume a more severe up-sloped position wherein the slackened chain can be removed. Then the hydrostatic actuator is controlled wherein the trailing end of the main frame can be correctly positioned to off-load debris from the earth saw. Note that in the active state of the conveyor, the rubber-tired trailer wheels affixed to the main frame, remain elevated above the earth's surface.

Conveyence of debris along the main frame of the conveyer is via an endless belt that movably stretches between a forward drum nd a drive drume both pivotally attached across the rail members of the main frame. The forward drum is positioned adjacent to but below the side opening in the shroud of the earth saw. The drive drum is positioned adjacent to the cantilevered trailing end of the main frame.

Note further that the system of the invention also includes the use of a rubber tired, self propelled vehicle downstream of the conveyor to collect the debris uplifted by the earth saw through the shroud and thence along the endless belt to an exit position above the vehicle. The vehicle has a maximum transverse width W2 and includes a truck bed positioned below the cantilevered far end of the main frame to catch by gravity the aforementioned debris as the latter exits by gravity from the endless belt. In correctly positioning the conveyor relative to the truck bed, note that the operator activates the hydrostatic actuator operatively positioned between a far end of the subframe and the far end of the main frame using the hydrostatic control unit positioned on the driving machine interfaced to the hydrostatic pump aboard the drive machine.

Note still further that the positioning of the system of the invention for trenching operations on a paved street, highway or the like, the individual widths of the elements of the system are still less than a single lane of the paved street, highway or the like on which the system may be operating.

BRIEF DESCRIPTION OF THE DRAWINGS

FIG. 12 is still another side view of the conveyor during the set-up procedure in which the trailing end of the main frame has reached a maximum height after which a chain is mounted to trailing end as the hydrostatic actuator is first deactivated and drawn upward toward the main frame so that the on-site wheels are free to be pivoted in a counter-clockwise direction and then activated so that wheels in phantom line are brought into rolling contact with the paved road or the like;

DESCRIPTION OF AN EMBODIMENT OF THE INVENTION

Figure 1:
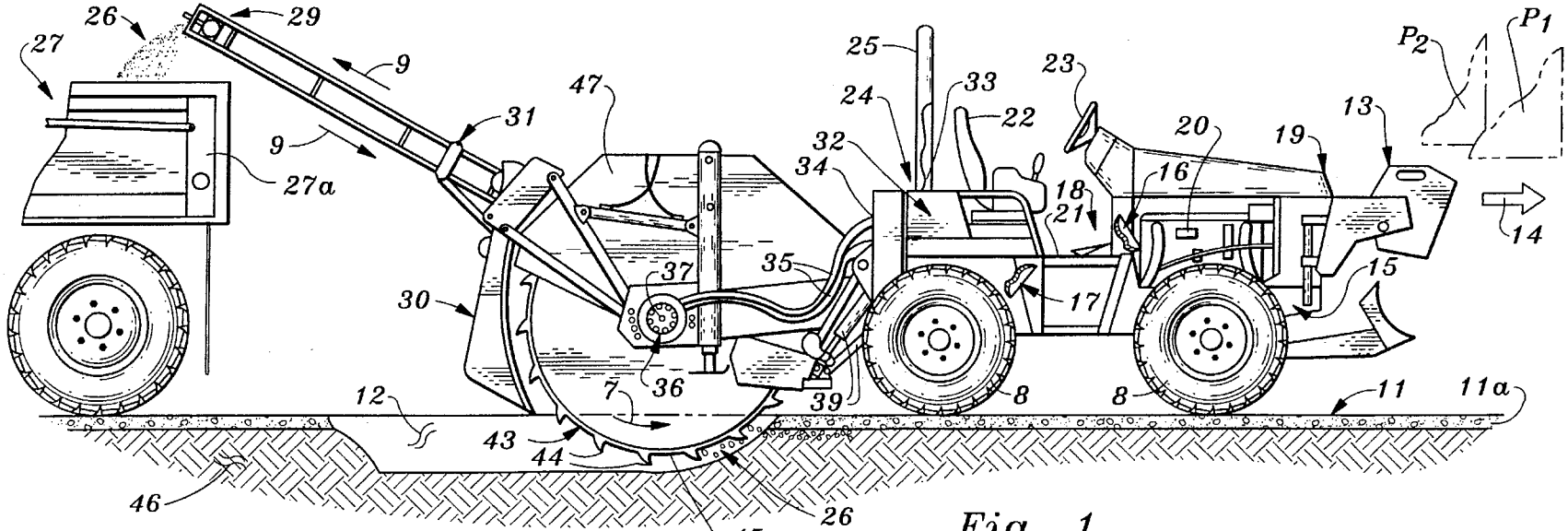
FIG. 1 is a right side view of the center-trenching system of the present invention illustrating its use in providing a groove through a paved street, road, highway or the like, such system including a rubber tired drive machine for transport of a center-line earth saw side-by-side of a conveyor forward of a rubber-tired debris-receiving vehicle.

Referring to FIG. 1, a center-line trenching system 10 shown for use at earth's surface 11 such as a paved street, road, highway 11*a*, for providing a center-line groove generally indicated at 12 in the surface 11 for laying a television cable, telephone line or the like. The system 10 includes a rubber tired self-propelled drive machine 13 movable in a longitudinal direction 14. The machine 13 comprises a frame 15 to which are attached rubber tired wheels 8 driven in rotation through a hydrostatic motor powered drive train generally indicated at 17. To the frame 15 a platform 18 is provided containing forward enclosure 19 for a prime mover such as an internal combustion engine 20, a mid-deck segment 21 to which a seat 22 for an operator is positioned along with a steering wheel 23, and a rear enclosure 24 to which a roll bar 25 is attached. In the forward enclosure 19 is a series of pumps, generally indicated at 16, say three in number in direct drive connection with the internal combustion engine 20. One of the hydrostatic pumps 16 is a component of the drive train 17 for the purpose of driving the wheels 8 of the drive machine 13. The remainder of the hydrostatic pumps 16 are used to in the operations of earth saw 30 and conveyor 31 of the invention in the manner set forth below. Between the roll bar 25 is provided a hydrostatic operations control unit 32 including valving levers 33 for controlling operations of the last mentioned hydrostatic pumps 16 relative to the earth saw 30 and conveyor 31. Note that at the rear enclosure 24, the operations control unit 32 previously mentioned, includes a series of hoses 35 extending therefrom attached to the earth saw 30, viz., to a hydrostatic motor 36 that drives central hub 37, and to a series of hydrostatic actuators 39 for controlling, inter alia, cutting operations of the earth saw 30 including varying the depth of the groove 12, as is conventional in the art. A rear surface 34 of the drive machine 13 is used to provide attachment of the former with the earth saw 30 and conveyor 31 as explained in more detail below.

Earth saw 30 also includes a cutting disc 43 having cutting protuberances 44 circumferentially spaced about its periphery 45, such disc 43 being provided with rotatary movement in the direction of arrow 7 after being adjusted to a selected depth in the earth formation 46 using the hydrostatic actuators 39. However, the cutting depth of groove 12 defined by a longitudinal working plane P1 normal to the surface 11, can be varied.

Figure 3:
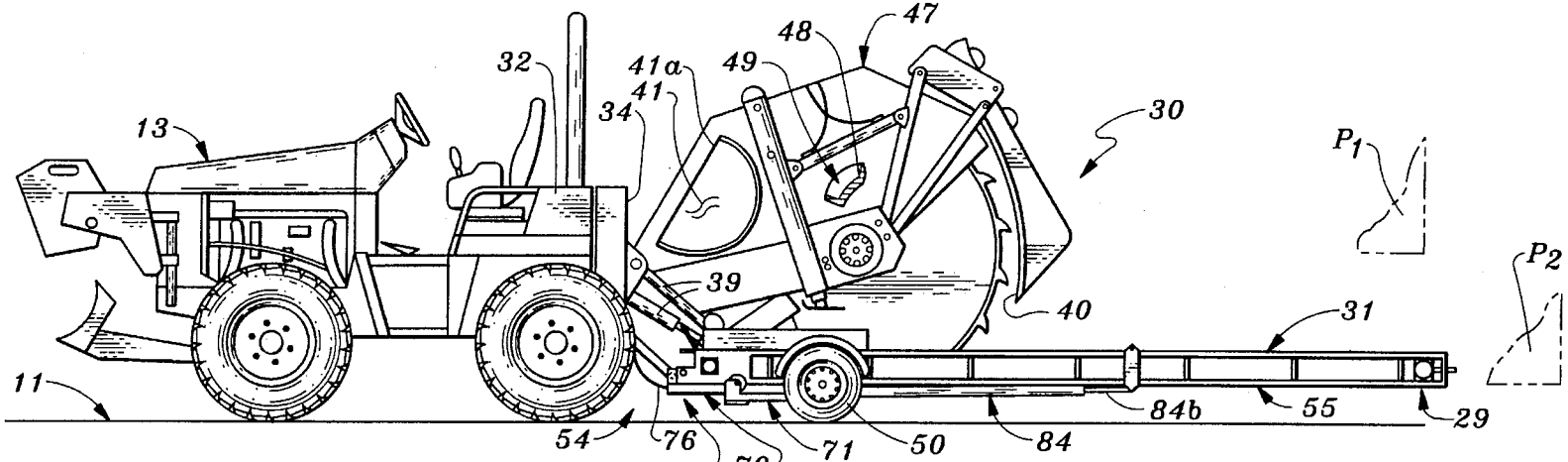
FIG. 3 is a left side view of the center-trenching system of FIG. 1, partially broken away, illustrating the start of the on-site set up procedures for the conveyor of the invention seen to be attached to the drive machine at a forward active end via pivot hitch wherein the trailering wheels used to trailer the conveyor to the job site, have not yet undergone upward travel via activation of a hydrostatic actuator housed between the subframe and main frame of the conveyor to permit a on-site wheel subassembly to be positioned to fully support the conveyor.

FIG. 3 is a view of the earth saw 30 preparatory to beginning the trenching operations of FIG. 1 in which hydrostatic actuator 39 have activated to elevate the cutting disc 43 above the earth's surface 11, and the conveyor 31 has been trailered to the job site but has not been oriented to assume a working position (as explained in detail below) adjacent to the earth saw 30 in orientation depicted in FIG. 1. As shown in FIG. 3, a shroud 47 for the earth saw 30 is provided wherein the shroud includes a lower segment 41*a* positioned to collect debris cut from the earth formation and also having a side wall 48 forming a cavity 49 is positioned over and about an upper sector of the cutting disc 43. The cavity 49 is provided with a first open region 40 in the vicinity of the earth's surface 11 and a side opening 41 located to one side of the longitudinal working plane P1 but elevated above said first open region 40. Such side opening 41 is in operational communication with the conveyor 31 during trenching operations as explained below. Returning to FIG. 1, suffice it say, that during trenching operations by the system 10, the conveyor 31 is used to receive debris 26 generated and carried upward into the shroud 47 by the protuberances 44 of the cutting disc 43, and thence through the side opening 41 (FIG. 3) onto the conveyor 31. Thus, it is evident that the shroud 47 cooperates with the motion of the cutting disc 43 to collect and convey debris 26 onto the conveyor 31 of the invention.

As shown in FIG. 1, the conveyor 31 and earth saw 30 are positioned side-by-side via attachment to the drive machine 13 at the rear surface 34 of the drive machine 13 whereby a second longitudinal working plane P2 that bisects the conveyor 31 is defined. Such working plane P2 is parallel with the first working plane P1. During trenching operations, the conveyor 31 and earth saw 30 proceed in the direction of arrow 14 at a common speed. Also proceeding at such common speed (and trailing the conveyor 31) is a rubbered tired dump truck 27 going in reverse gear. Such dump truck 27 includes truck bed 27*a* that is positioned below remote trailing end region 29 of the conveyor 31 whereby the gathered debris 26 exiting from the conveyor 31, is loaded onto the truck bed 27*a* of the dump truck 27.

Figure 2:
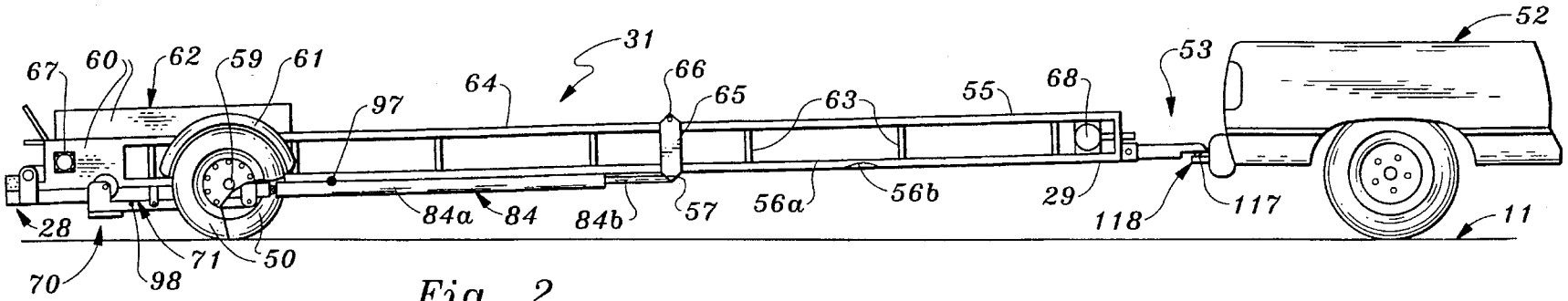
FIG. 2 is a right side view of the conveyor of FIGS. 1 and 3 before its attachment to the drive machine of FIGS. 1 and 3 showing that its trail end in FIG. 1 is provided with a hitch for attachment to a trailering vehicle, such as a pick up truck.
Figure 4:
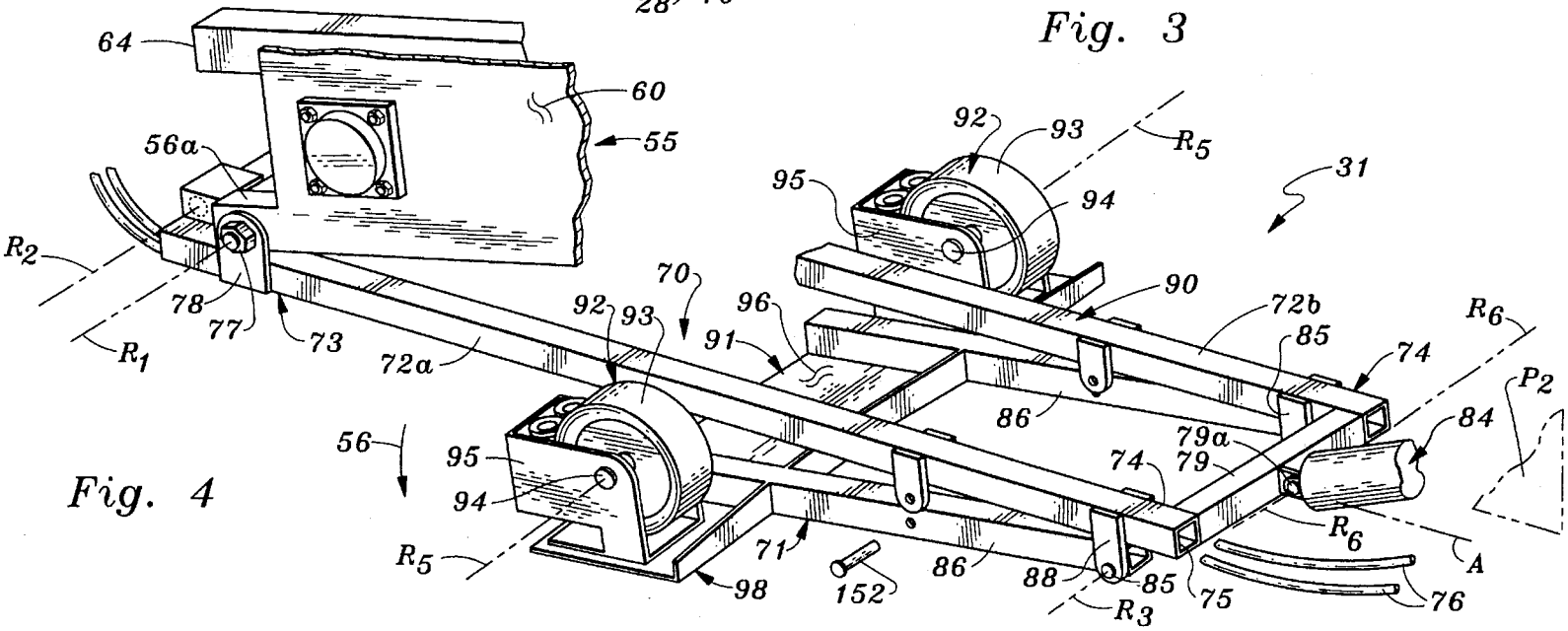
FIG. 4 is a perspective detail showing attachment of the main frame, subframe including hydrostatic actuator and on-site wheel subassembly of FIG. 3, relative to each other.

FIGS. 2, 3 and 4 illustrate the conveyor 31 during different aspects of operations. FIG. 2 shows the conveyor 31 in a trailering mode, such conveyor 31 using a pair of rubber tired trailering wheels 50 that tangentially contact the earth's surface 11 and allow the conveyor 31 to trailered each day to the job site. Note in this mode of operation, the conveyor 31 is attached to a towing vehicle such as a pick-up truck 52 via a conventional tongue-ball hitch 53. On the other hand, FIG. 3 illustrates the start of the on-site set up procedures for the conveyor 31 in which the pick-up truck 52 of FIG. 2 has placed the conveyor 31 adjacent to the rear surface 34 of the drive machine 13 and the operator has provided attachment therebetween via pivot hitch 54. Note that the tongue-ball hitch 52 of FIG. 2, is positioned at the remote trailing end region 29 of the conveyor 31, while the pivot hitch 54 of FIG. 3 is oppositely located at near end region 28 of the conveyor 31. Note that the pivot hitch 54 will be bisected by the second working plane P2 during trenching operations of the system 10 of FIG. 1.

Figure 7:
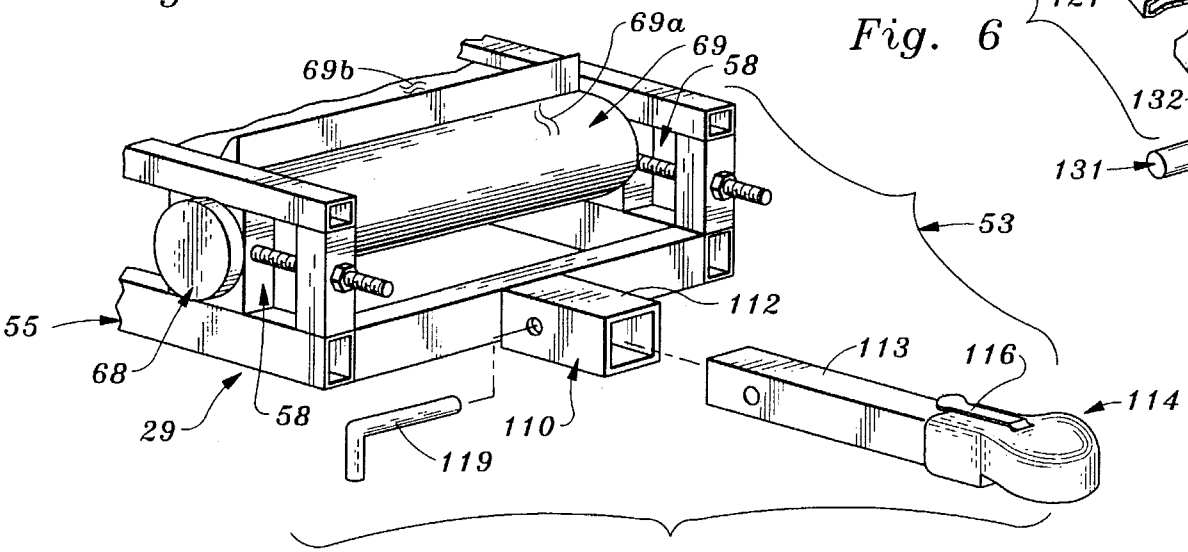
FIG. 7 is a perspective detail of the hitch used in trailering the conveyor of the invention to the job site by the pick-up truck of FIG. 2.

Referring to FIGS. 2 and 4, note that the conveyor 31 includes a main frame 55 consisting of a pair of elongated side rail members 56*a*, 56*b* of rectangular cross section. The side rail members 56*a*, 56*b* are provided with a pair of cross members to complete structural integrity, one of the cross member 57 being positioned in a mid-region of the main frame 55. The other cross member (not shown) of the main frame 55 extends between the side rail members 56*a*, 56*b* at the location of axle 59 of the trailer wheels 50, such other cross member also fixedly supporting such axle 59 to permit rotation of the trailer wheels 50 relative to the earth's surface 11. Also attached to the side rail members 56*a*, 56*b* is a series of wall members 60 and fenders 61. The wall members 60 are seen to attach to and cantilever above the side rail members 56*a*, 56*b* to form a debris receiving enclosure 62. The fenders 61 extend above a sector of the trailer wheels 50. Between the enclosure 62 and remote trailing end 29, a series of pickets 63 are provided in cantilevered attachment relative to the side rail members 56*a*, 56*b* terminating in the vertical direction, in top bars 64 and in the longitudinal direction, in the near end region 28 and in the trailing remote end region 29. Also positioned between the side rail members 56*a*, 56*b* is a follower drum 67 at the near end region 28, a hydrostatically operated drive drum 68 positioned adjacent to the trailing remote end region 29 and an endless belt 69 stretched therebetween. The follower drum 67 and the hydrostatical operated drive drum 68 are placed in pivotal attachment with the side rail members 56*a*, 56*b* and top bars 64 in typical fashion. For example, as shown in FIG. 7, the drive drum 68 is journaled to a pair of keeper block subassemblies 58. The endless belt 69 is located in tangential contact about the drive drum 68 to define a two ply configuration wherein the outwardly facing surface 69*a* with a series of cleats 69*b*. During operations as shown in FIG. 1, the endless belt 69, is provided with of rectilinear motion in the direction of arrows 9 to convey the debris 26 unto the truck bed 27*a* of the dump truck 27.

Returning to FIG. 2, note that a pair of gussets 65 are welded at the mid-region of the main frame 55 viz., at the ends of the cross member 57, to provide structural integrity when a chain (not shown) is attached to eyelets 66 for support of the conveyer 31 as explained in more detail below.

However, note in FIGS. 3 and 4, that the main frame 55 does not connect directly to the rear surface 34 of the driving machine 13. Instead a subframe 70 is positioned below the main frame 55 and is used for this task as well as aid in the manipulation of on-site wheel subassembly 71 as explained below.

Figure 8:
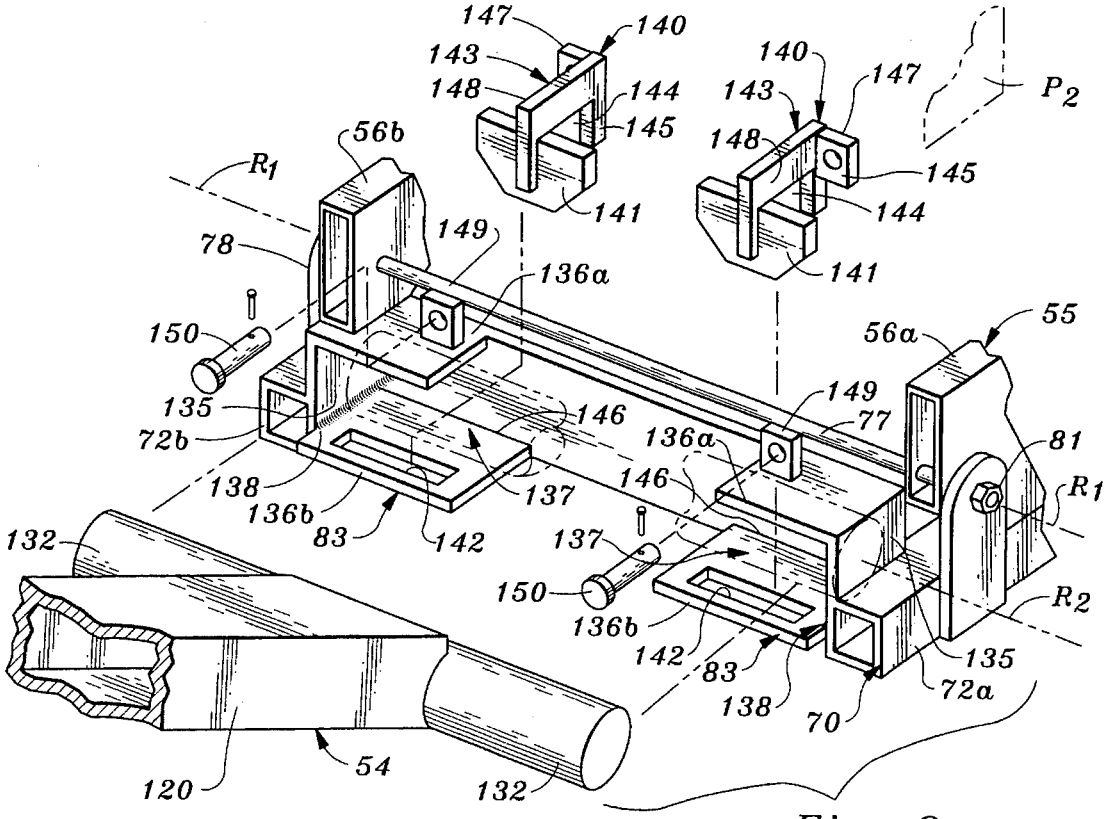
FIG. 8 is a perspective detail of the female element of the pivot hitch of FIG. 3.

FIGS. 2, 4 and 8 illustrate the subframe 70 and an on-site wheel subassembly 71 in more detail.

As shown in FIG. 4, the subframe 70 extends below the main frame 55 and includes a pair of elongated truss members 72*a*, 72*b* each being of a square cross section and defining a forward end region 73, a rear end region 74 and a central cavity 75. Within cavity 75 of the truss member 72*a* is positioned a pair of hydrostatic hoses 76 connected upstream to the control unit 32 aboard the driving machine 13, see FIG. 3. Attached between the truss members 72*a*, 72*b* of the subframe 70 is a cross bar 77 for pivotally securing and establishing an axis of rotation R1 for the main frame 55 relative to the subframe 70 using a pair of upwardly directed ears 78 (see FIG. 8) attached to the truss members 72*a*, 72*b*. As shown in FIG. 8, the ears 78 and the rail members 56*a*, 56*b* of the main frame 55 have aligned openings (not shown) through which the cross bar 77 extends and wherein fasteners 81 positionally fix the bar 77 relative to the ears 78 and hence relative to the rail members 56*a*, 56*b*. Note that the axis of rotation R1 established for the main frame 55 relative to the subframe 70, is normal to the working plane P2. Also within the forward region 73 there is also a pair of U-female stubs 83 that is a component of the pivot hitch 54 as explained below, each of the female stubs 83 facing toward the working plane P2 and defining an axis of rotation R2 for the subframe 70. Such axis of rotation R2 parallel to axis of rotation R1 for the main frame 55 relative to the subframe 70 with both being normal to the working plane P2.

Returning to FIG. 4, the truss members 72*a*, 72*b* are also provided with a cross member 79 at the rear region 74 to which is pivotally attached a hydrostatic actuator 84 via pivot hinge 79*a* welded to the mid-span of the cross member 79. As shown in FIG. 2, the hydrostatic actuator 84 is seen to include an actuating cylinder 84*a* and a movable piston 84 those operations are detailed below. Returning again to FIG. 4, adjacent to the cross member 79, there is also positioned first and second pairs of downardly directed ears 85 for pivotally attaching the on-site wheel subassembly 71 relative to the truss members 72*a*, 72*b* of the subframe 70. Such ears 85 establish yet another axis of rotation R3 also normal to the working plane P2.

Figure 5:
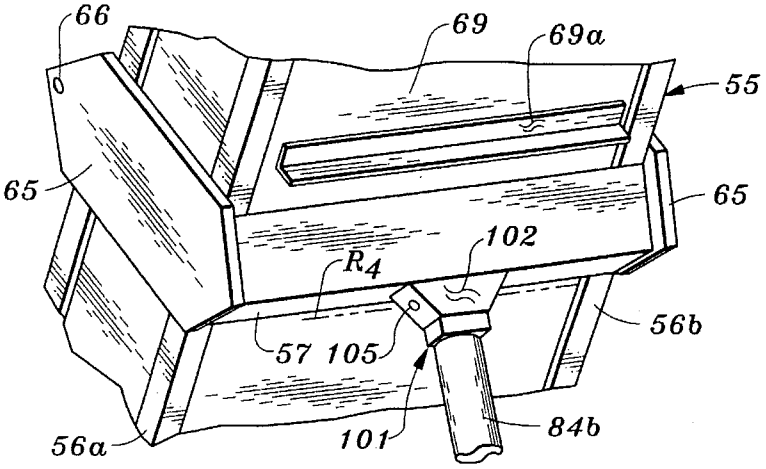
FIG. 5 is perspective detail showing attachment of the hydrostatic actuator relative to the trail end of the main frame of FIG. 4.

FIG. 5 shows the hydrostatic actuator 84 in more detail.

As shown, the actuator 84 includes piston 84*b* having an end region 101 attached to cross member 57 of the main frame 55. In this regard, the cross member 57 is seen to L-shaped in cross section and is attached to the rail members 56*a*, 56*b* of the main frame 55 as well as to gussets 65. Attachment of the piston 84*b* is via a receiver box 102 welded to the mid-region of the cross member 57, the box 102 being pivotally attached to the end region 101 of the piston 84*b* via pivot pin 105 to define an axis of rotation R4 parallel to the previously defined axes of rotation.

In the set-up procedure for the conveyer 31 that begins as shown in FIGS. 2 and 3, the hydrostatic actuator 84 is operative connected to via one of the hydrostatic hoses 76 upstream to the control unit 32 aboard the driving machine 13 (see FIG. 3), whereby elongation or shortening the position of the piston 84*b* relative to cross member 57 (see FIG. 2, provides on-site movement between the main frame 55, subframe 70 and actuator 84 as described in detail below.

Returning to FIG. 4, an on-site wheel subassembly 71 is seen include a pair of pivot arms 86 pivotally attached to an associated truss member 72*a*, 72*b* via pivot pins 88 extending through aligned openings in the ears 85 and in the truss members 72*a*, 72*b*. At an opposite end region 90 of each arm 86 there is provided a cross plate 91 to which is attached a pair of heavy duty, spring loaded swivel caster units 92. The caster units 92 comprise rubber-tired wheels 93 rotatable about axle 94 to define another axis of rotation R5 also normal to the working plane P2, and cantilevered collars 95 each of which pivotally attach to the cross plate 91 through a bearing (not shown) so as to permit the caster units 92 to swivel 360 degrees about a pair of axes normal to broad surfaces 96 of the cross member 91 normal to the axis of rotation R5. Such caster units 92 are manufactured by Albon Caster Company, USA.

FIG. 7 shows the tongue-ball hitch 53 in more detail. As shown, the hitch 53, includes a T-shaped receiver member 110 of square cross section welded to the remote end 29 of the main frame 55 wherein base leg 112 is sized to receive male tongue 113. The male tongue 113 defines a ball-receiver segment 114 at its remote end region 115. The ball-receiver segment 114 includes a latch 116 for releasably connecting the receiver segment 115 relative to a standard ball receiver 117 (see FIG. 2) attached to bumper 118 of the pick-up truck 52. Returning to FIG. 7, a L-shaped key 119 is used to secure the tongue 113 to the T-shaped receiver member 110. Note that loading at the tongue-ball hitch 53 is a minimum value during trailering operations. As shown in FIG. 2, when the hitch 53 is secured to the pick-up truck 52, the loading is in the range of 50 to 150 pounds because center of gravity 97 of the conveyor 31 is positioned just beyond the trailering wheels 50, with the main frame 55 being horizontally positioned relative to the subframe 70 and the earth's surface 11. That is, as shown in FIG. 8 in the trailering mode of operation, the truss members 72*a*, 72*b* of the subframe 70 are placed in broad parallel contact with adjacent segments of the rail members 56*a*, 56*b* of the main frame 55, throughout the length of the former. However the remainder of the rail members 56*a*, 56*b* are unsupported and horizontally cantilever from the subframe 70 for attachment through tongue-ball hitch 53 of FIG. 2 to the pick-up truck 52.

Figure 6:
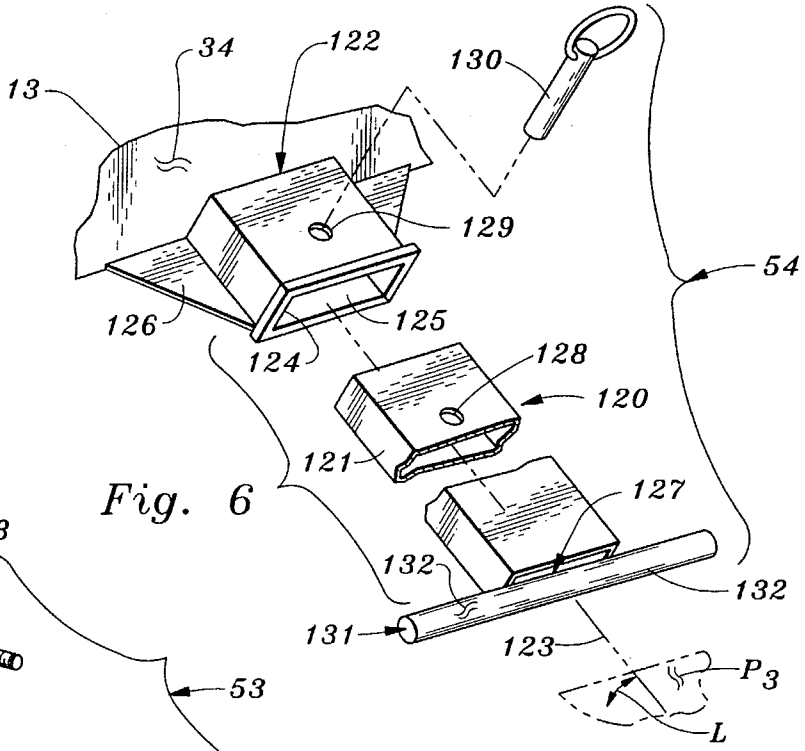
FIG. 6 is a perspective detail of the male element of the pivot hitch of FIG. 3.

FIGS. 6 and 8 also show the pivot hitch 54 in more detail.

As shown in FIG. 6, the pivot hitch 54 includes a male element 120 in the shape of the letter "T" whose base leg 121 is fixedly attached to rear surface 34 of the drive machine 13 via female box receiver 122 wherein an angle L is defined between its axis of symmetry 123 and a normalizing plane P3 parallel to the earth's surface. The angle L remains fixed during all operations of the system 10. As shown, the female box receiver 122 is permanently attached at the rear surface 34 of the drive machine 13 and includes side walls 124 defining a cavity 125. A base plate 126 is welded to one of the side wall 124 along a broad lower surface thereof, followed in turn by butt welding the base plate 126 and side walls 124 to the rear surface 34 of the drive machine 13. The cavity 125 of the female box receiver 122 is sized to slidably receive the base leg 121 of the mate element 120 wherein axis of symmetry 123 of the latter is coincident with that of the female receiver 122. Hence the position of the male element 120 relative to the drive machine 13 remains constant during operations and is defined by the angle L. After the base leg 121 of the male element 120 is inserted within the female receiver 122, note that openings 128, 129 in the male element 120 and female receiver 122, respectively, become aligned to receive a latch pin 130.

Transverse leg 131 of the T-shaped mate element 120 is of a circular cross section and includes a midportion 127 welded to the base leg 112, to provide a pair of free end portions 132 off-set from its junction with the, base leg 121. As shown in FIG. 8, recall that the subframe 70 is provided with a pair of female stubs 83. Each of the female stubs 83 face toward the working plane P2 and define the axis of rotation R2 previously mentioned, which is positionally fixed in elevation during all trenching operations, viz., when free end portions 132 of the male element 120 are captured in the female stubs 83 in the manner depicted in phantom line. Now in more detail each female stub 83 is U-shaped in cross section but rotated so its open end faces the working plane P2. After its base leg 135 is welded to the interior of truss members 72*a*, 72*b*, its pair of legs 136*a*, 136*b* cantilever outwardly from the base leg 135 in parallel fashion since the lower parallel leg 136*b* has been welded to the base leg 135 via weld 138 to be parallel to the upper leg 138*a*. Such positioned base and parallel legs 135, 136*a*, 136*b* form three sides of a pocket 137 for capture of the free end portion 132 of the male element 120. Remaining two sides of each pocket 137 are provided by a T-shaped hanger 140 having a longitudinal arm 143 and a transverse arm 141 that fits within slot 142 of an associated parallel leg 136*b* of each of the female stubs 83. The longitudinal arm 143 of each T shaped hanger 140 is formed with a cavity 144 sized to fit about the free end portions 132 of the male element 120 as well as provides a boss 145 that contacts an end edge 146 of the associated parallel legs 136*b* of each of the female stubs 83.

Positional integrity of each T-shaped hanger 140 with each female stub 83 is maintained by alignment of an eyelet 147 (welded to side surface 148 of the longitudinal arm 143 of the T-shaped hanger 140), with an eyelet 149 (welded to the top surface of the parallel leg 136*a* of each associated female stub 83). A latch pin 150 through the eyelets 147, 149 completes attachment.

That is to say, after the free end portions 132 of the male element 120 are positioned onto the parallel legs 136*b* of the female stubs 83 as shown in phantom line, viz. between the slots 142 and end edges 146, the T-shaped hangers 140 are fitted over the parallel legs 136*a*. As a result, at each female stub 83, a portion of the transverse arm 141 of each hanger 140 fits within the slot 142 in the parallel leg 136*b* while boss 145 contacts the end edge 46 of the same parallel leg 136*b*. In such positions, the eyelets 147, 149 become aligned so that latch pins 150 can be inserted therethrough. In that way, the male element 120 is engaged relative to the female stubs 83 and T-shaped hangers 140 (the latter two elements forming the female element of the pivot hitch 54) to secure the conveyor 31 relative to drive machine 13 of FIG. 3 but permitting pivoting of entire conveyor 31 via the subframe 70 about axis of rotation R2 normal to the working plane P2.

FIGS. 9–14 illustrate further set-up procedures for the conveyor 31 of the invention. In this regard assume that the conveyor 31 has been attached to the rear surface 34 of the drive machine 13 in the manner set forth in FIGS. 2, 6 and 8. That is, the set-up procedure proceeds from a time sequence that includes the V) of trailering the conveyor 31 supported by the trailer wheels 50 to the job site using the pick-up truck 52 of FIG. 2 attached via tongue-ball hitch 53. In this regard, note that the on-site wheel subassembly 71 is stowable in an areal location 150 wherein its center of gravity 98 is between the trailering wheels and the near end region 28 of the conveyor 31. Also, since the center of gravity 97 of the entire conveyor 31 is longitudinally located slightly forward of the trailering wheels 50 during the trailering of the conveyor 31 to the job site, hence the downward loading of the tongue-ball hitch 53 is not large, say in a range to 50 to 150 pounds allowing easy trailering by the pick-up truck 52. Assume also that the V of positioning and attaching the conveyor 31 to the drive machine 13 using the pivot hitch 54 has occurred as shown in FIG. 3. That is, the conveyor 31 has been attached to the rear surface 34 of the driving machine 13.

Note in this regard in FIG. 3 that the on-site wheel subassembly 71 is stowable parallel to the subframe 70 in a position that is between the trailering wheels 50 and the near end region 28 of the conveyor 31. Thereafter, the wheel subassembly 71 is released from contact with the subframe 70 via release of a pair of latch pins 152, see FIG. 4, from contact with aligned openings in two sets of parallel ears 154 as well as in the pivot arms 86. Each set of the parallel ears 154 are seen to be positioned on opposite surfaces of the truss members 72*a*, 72*b* of the subframe 70. As a result of such release of the latch pins 152, the on-site wheel subassembly 71 rotates in counterclockwise direction as indicated by arrow 156 about axis of rotation R3.

Figure 9:
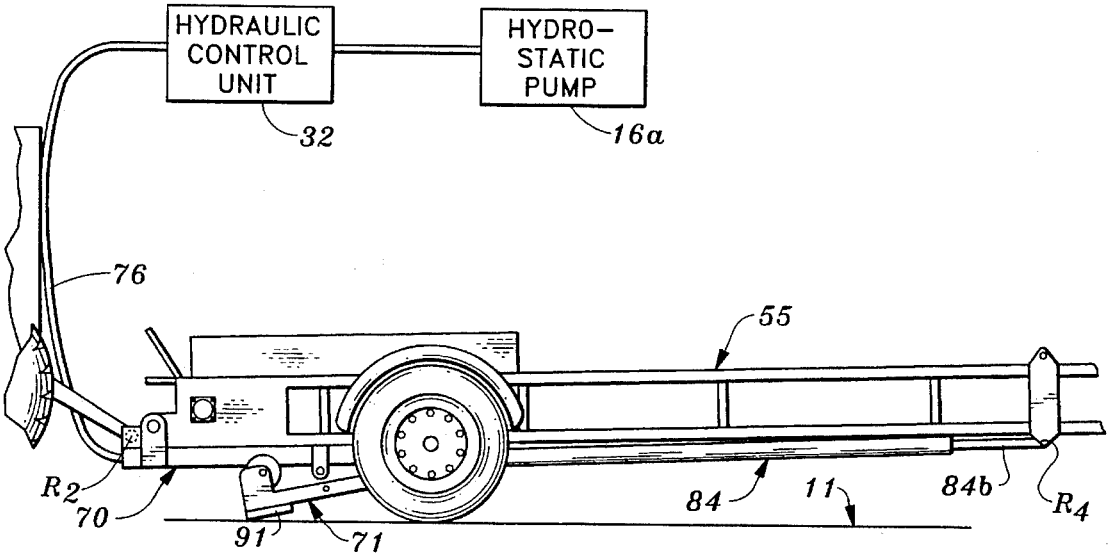
FIG. 9 is another side view of the conveyor of FIG. 3 in which the set-up procedure, partially in schematic form, is further illustrated wherein the on-site wheel subassembly has been disengaged from the main frame and wherein the hydrostatic actuator between the subframe and main frame is shown to operative connect to a hydrostatic pump through a control unit aboard the drive machine.

FIG. 9 depicts the final position of wheel subassembly 71 after its release from the subframe 70. As shown the cross plate 91 of the wheel subassembly 71 makes contact with the earth's surface 11.

Then, the hydrostatic actuator 84 is activated via pressure actuation thereto via hydrostatic pump 16*a* controlled by the hydrostatic control unit 32 through one of the hydrostatic hose 76. Such activation results in controlled elongation of the position of the piston 84*b* of the actuator 84 relative to its axis of rotation R4 with respect to the main frame 55, resulting in the subframe 70 undergoing pivotal movement about its axis of rotation R2.

Figure 10:
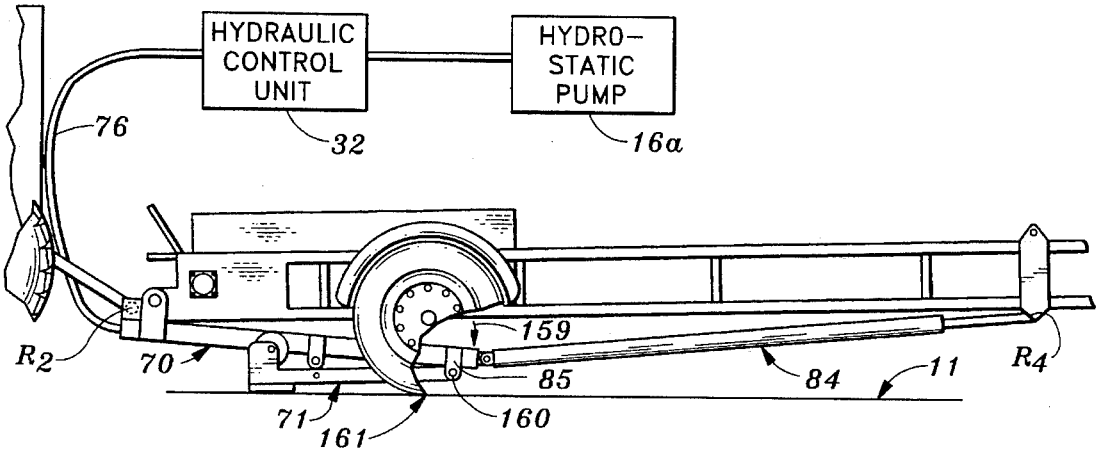
FIG. 10 is another side view of the conveyor of FIG. 9 in which the set-up procedure, partially in schematic form, is further illustrated in time wherein the hydrostatic actuator has been activated to drive subframe and on-site wheel subassembly into engagement with the paved road or the like prior to elevating the trailing end of the main frame.

FIG. 10 depicts the movement of the subframe 70, the on-site wheel subassembly 71 and the hydrostatic actuator 84 in more detail. As shown, the wheel subassembly 71 pivots about its axis of rotation R2 in the direction of arrow 159 until domed surfaces 160 of the first and second pairs of ears 85 of the wheel subassembly 71 make contact with the earth's surface 11 wherein a reaction fulcrum 161 is formed. With subframe 70 then being essentially positionally fixed, further activation of the actuator 84 then occurs as shown in FIG. 11.

Figure 11:
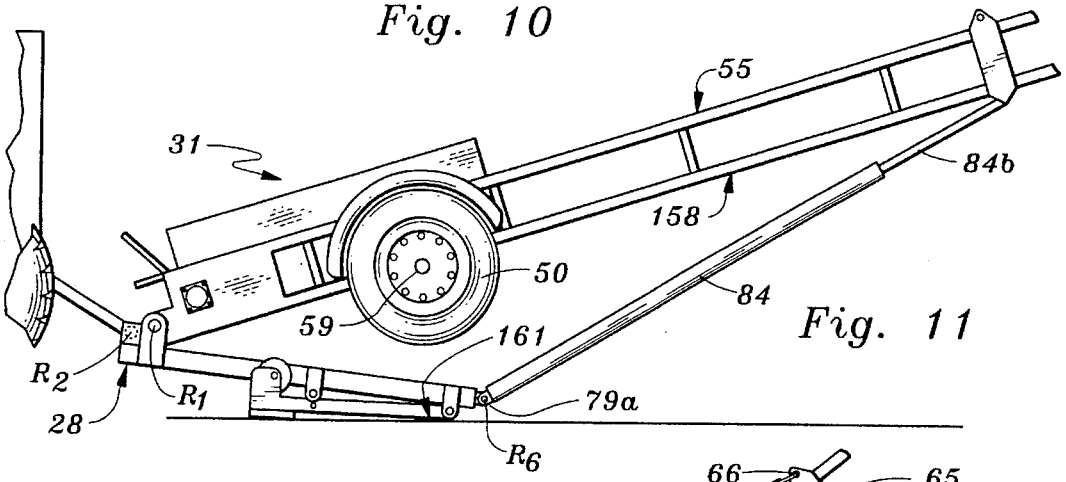
FIG. 11 is yet another side view of the conveyor of FIG. 10 in which the trailing end of the main frame is being lifted by the activation of the hydrostatic actuator wherein the trailering wheels are lifted off the paved road or the like but not the on-site wheel subassembly.
Figure 12:
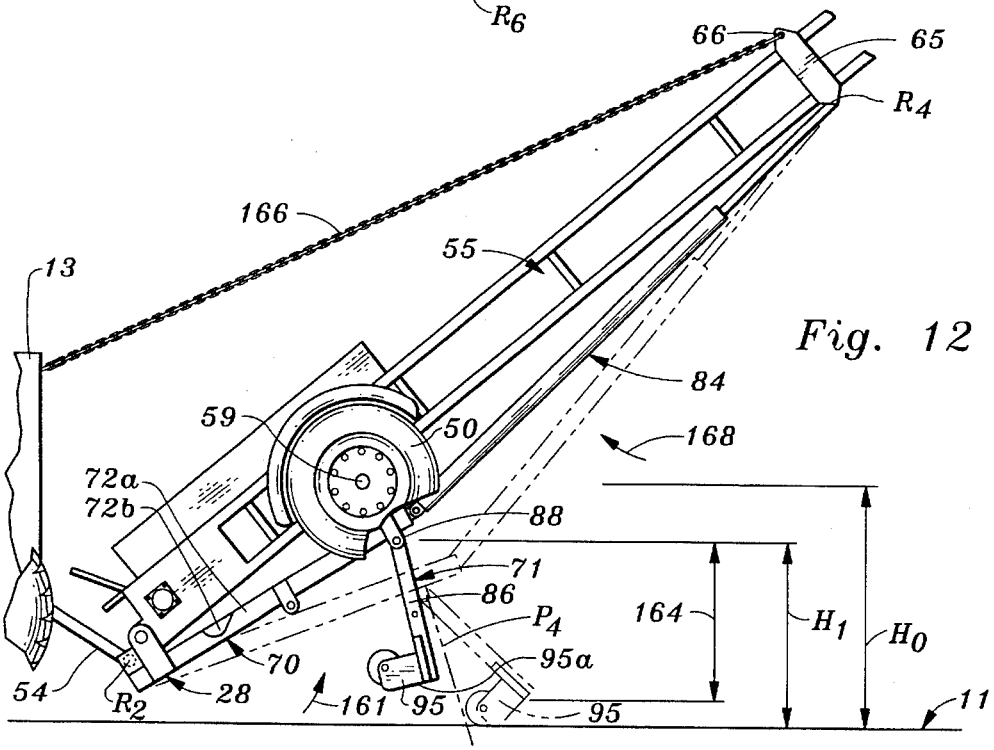

As shown in FIG. 11, further activation of the actuator 84 causes the actuator 84 to rotate of yet another axis of rotation R6 between the actuator 84 and the subframe 70 at hinge 79*a* in the direction of arrow 158. Result: the main frame 55 pivots about the axis of rotation R1 between the main frame 55 and the subframe 70 also in the direction of arrow 158 as shown so that the trailer wheels 50 are elevated above the earth's surface 11. The subframe 70 is essentially motionless. That is, with the fulcrum 161 established, the main frame 55 undergoes pivoting movement about axis of rotation R1 between it and the subframe 70 since the latter in firm contact with the surface 11 as a function of elongation of piston 84*b* of the actuator 84. Result: the trailering wheels 50 are lifted well above the earth's surface 11 as shown in FIG. 11. When the trailer wheels 50 attain a pre-determined height measured between its axle 59 and the earth's surface 11, activation of the actuator 84 is terminated and a chain 166 as shown in FIG. 12 is attached through the gussets 65 of the main frame 55 via eyelets 66 and thence to the drive machine 13. Such chain 166 essentially supports the entire conveyor 31. Note that the main frame 55 has assumed a up-sloped position relative to the near end region 28 of the conveyor 31.

Next, the actuator 84 is used to tension the chain 166 in the manner of FIG. 12 by deactivating the actuator 84 wherein a pre-determined height Ho of the trailer wheels 50 relative to the earth's surface 11 is generated. Further deactivation of the actuator 84 then occurs until the subframe 70 (and the ears 85 of the on-site wheel subassembly 71) are brought into an upsloped position below the main frame 55 as shown in solid line in FIG. 12. That is, as deactivation of the actuator 84 occurs, the subframe 70 undergo pivoting movement relative to axis of rotation R2 between the pivot hitch 54 and the subframe 70, while at the same time, the actuator 84 undergoes rotation about axis of rotation R4. The first mentioned movement is in the direction of arrow 167 and the second mentioned movement is in the direction of arrow 168. When a pre-determined height H1 of the ear 85 occurs, such height H1 being measured from the pivot pins 88 extending through the ears 85 to the earth's surface 11, deactivation of the actuator 84 ceases. Note that the height H1 is greater than swing radius 164 of the pivot arms 86 and collars 95 of the on-site wheel subassembly 71. Hence the pivot arms 86 of the wheel subassembly 71 are free to undergo counterclockwise rotation about the pivot pins 88 since the edges 95*a* of the collars 95 of the on-site wheel subassembly 71 (the lowest surface of the subassembly 71 relative of the earth's surface 11) are well above the surface 11. In that way, the pivot arms 86 can be pivoted to an over center position measured relative to the transverse plane P4 that bisects the ears 85 and its normal to the axes of symmetry of the truss members 72*a*, 72*b* of the subframe 70. After overcenter rotation has been achieved by the pivot arms 86, the actuator 84 is activated wherein the subframe 70 and actuator 84 assume the positions therefor depicted in phantom line whereby swivel wheels 93 can make rolling contact with the earth's surface 11.

Figure 13:
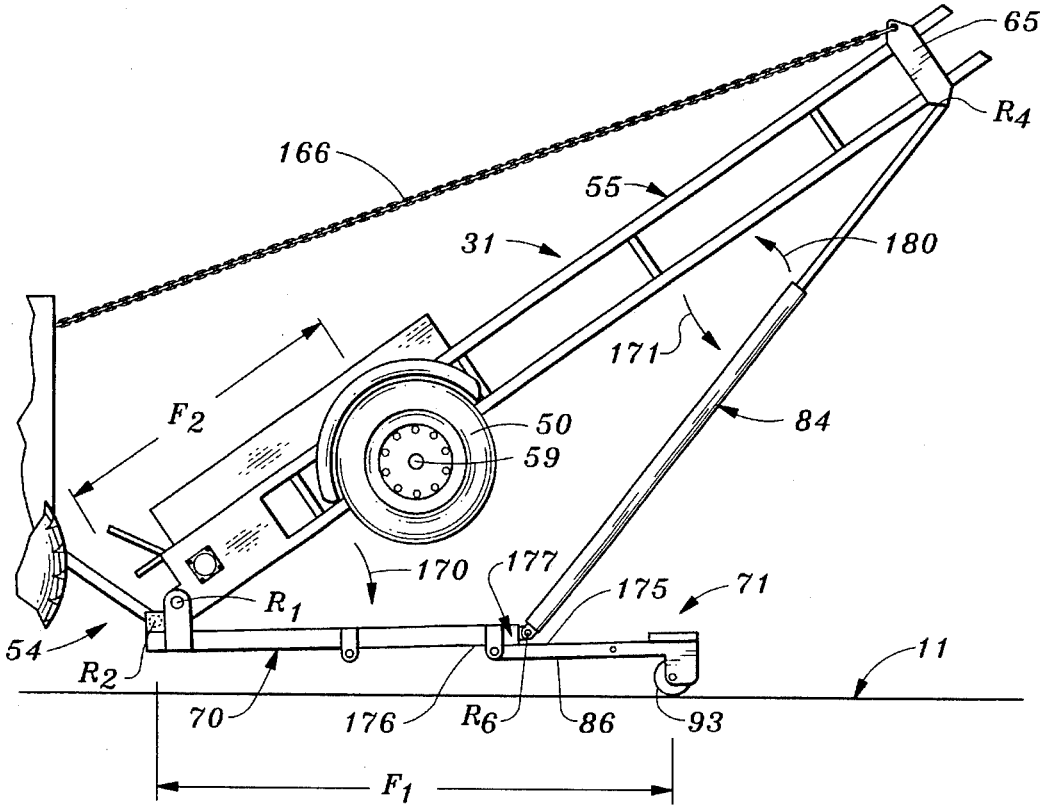
FIG. 13 is still another side view of the conveyor during the set-up procedure in which the wheels of the on-site wheel subassembly are in contact with the paved road or the like in full support of the main frame so that thereafter when the hydrostatic actuator is activated to further elevate the trailing end of the main frame, the chain slackens and can be removed.

The result of further activation of the actuator 84 is shown in FIG. 13 wherein the subframe 70 has completed is rotational movement about the axis of rotation R2 in the direction of arrow 170 simultaneous with completion of the rotation of the actuator 84 about the axis of rotation R4 in the direction of arrow 171. Note that the pivot arms 86 of the on-site wheel subassembly 71 are now locked in position wherein the upper surfaces 175 of the pivot arms 86 are placed in broad contact against the lower surfaces 176 of the rail members 56*a*, 56*b* over aligned segments 177.

In such position as shown in FIG. 13, note that the swivelable wheels 93 and the remainder of the on-site wheel subassembly 71 define a radius of formation F1 centered at axis of rotation R2 between the pivot hitch 54 and the subframe 70. Such radius of formation F1 is seen to be greater than radius of formation F2 associated with axle 59 of the trailer wheels 50. As a consequence, there has been a re-distribution of the weight of the conveyor 71 because of the re-positioning of the on-side wheel subassembly 71. That is, the center of gravity of the conveyor 31 is shifted toward the gussets 65 of the main frame 55. Thereafter, the actuator 84 is again activated to so that the actuator 84 pivots about axis of rotation R6 in the direction of arrow 180, as at the same time, the main frame 55 rotates about the axis of rotation R1 in the same direction as arrow 180. Such movements cause the chain 166 to go slack wherein the latter is removed from contact with the gussets 65 of the main frame 55.

Figure 14:
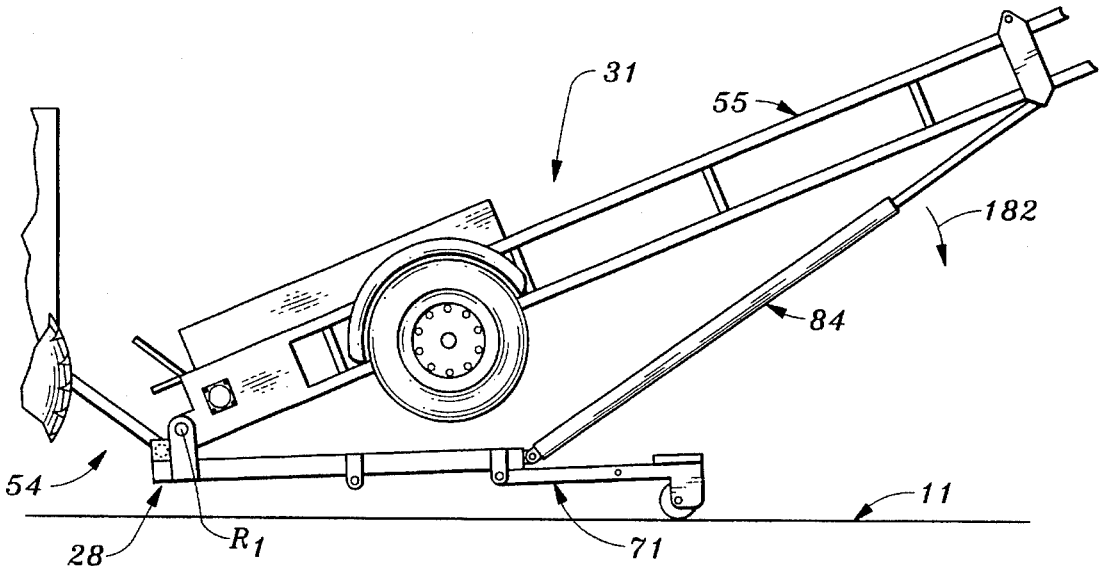
FIG. 14 is another side view of the conveyor during the set-up procedure in which the chain of FIG. 13 has been removed and the trailing end of the main frame positioned for operations in accordance with FIG. 1.

Finally, as shown in FIG. 14, the actuator 84 is again deactivated so that the actuator 84 pivots about axis of rotation R6 in the direction of arrow 182, as at the same time, the main frame 55 rotates about the axis of rotation R1 in the same direction of arrow 182 to provide the final ramped working position of the conveyor 31 that is seen to be up-sloped relative to its near end region 28 and to the earth's surface 11 wherein such final ramped working position of the main frame 55 is similar to that depicted in FIG. 1. However, even though the weight of the conveyor 31 has been re-distributed because of the repositioning of the on-side wheel subassembly 71, note that loading at the pivot hinge 54 is still minimum (say in a range of 25 to 175 pounds) due to the fact that the weight of the main frame 55 acting at its center of gravity:has a component which compensates for such redistribution. That is, loading at the pivot hinge 54 is still minimum, say in a range of 25 to 175 pounds due to the fact that weight of the main frame 55 in the final on-site position of the conveyor 31 as shown in FIG. 14 has a component that acts at the pivot hitch 54 that compensates for the weight shift due to the change in position of the on-site wheel subassembly 71 from the upfolded position of FIG. 2 to the final on-site position of FIG. 14.

In summary, the actuator 84 is utilized in the set-up procedure to provide on-site movement between the main frame 55 and subframe 70 as described in detail above. Suffice to say, the control unit 32 is operative attached to the hydrostatic actuator 84 so as to provide these functions at the job site:

(i) to cause the piston 84*b* of the actuator 84 to elongate to provide a linear force between the main frame 55 and the subframe 70 whereby the subframe 70 rotates downward toward the earth's surface 11 in a clockwise direction as shown in FIG. 10, about its axis of rotation R2 defined by the coupling axis of the pivot hitch 54 with the subframe 70 whereby its ears 85 are lowered into contact with earth's surface 11 to form a reaction fulcrum 161. Then using reaction fulcrum 161, further activation of the actuator 84 elevates the unsupported end of main frame 55 well above the earth's surface 11 as shown in FIG. 12 by rotating the main frame 55 in a counterclockwise direction, about its pivot axis of rotation R1 with the subframe 70 while the axis R2 of the male and female elements of the pivot hitch 54 and subframe 70 is maintained in a relatively fixed position relative to the earth's surface 11. Such rotation steps when the rubber tired trailer wheels 50 are clear the earth's surface 11 by a substantial height, (ii) after attaching a length of chain 166 as shown in FIG. 12, i.e. to the eyelets 66 of the gussets 65 of the main frame 55 and thence to the drive machine 13, the position of the main frame 55 relative to the earth's surface 11 is stabilized. Then the actuator 84 is deactivated to shorten the position of the piston 84*b* which causes the subframe 70 to be repositioned to a sloped position just below the fixed sloped position of the main frame 55 as shown in FIG. 12, (iii) permitting the pivot arms 86 of the on-site wheel assembly 71 to rotate in the counterclockwise direction to an overcenter position relative to a vertical centering plane P4, whereby further activation of the actuator 84 allows the swivelable wheels 93 of the caster units 92 to be placed in tangential rolling contact with the earth's surface 11, as shown in phantom line in FIG. 12, (iv) continuing activating the piston 84*b* of the actuator 84 to lock the pivot arms 86 of the on-site wheel subassembly 71 wherein the upper surfaces 175 of the pivot arms 86 are placed in broad contact against the lower surfaces 176 of the truss members 72*a*, 72*b* at aligned segments 177 as shown in FIG. 13. In such position, the swivelable wheels 93 and the remainder of the on-site wheel subassembly 71 can fully support the main frame 55 so that with further activation of the actuator 84 causes the chain 166 to slacken and to be removed, (v) Thereafter, the actuator 84 is deactivated so that the main frame 55 is lowered to its final ramped loading position as shown in FIG. 14. Note that even though the weight of the conveyor has been re-distributed because of the repositioning of the on-side wheel subassembly 71, loading at the pivot hinge 54 is still minimum (as set forth above) due to the fact that the weight of the main frame 55 acting at its center of gravity, see FIG. 14 has a component which compensates for such redistribution. Hence the on-site wheel subassembly 71 fully accepts and reacts to forward movement of the drive machine 13 as shown in FIG. 1. That is, loading at the pivot hinge 54 is still minimum, at the pivot hitch 54 due to the fact that weight of the main frame 55 in the final on-site position of the conveyer 31 as shown in FIG. 14 has a component that acts downward at the pivot hitch 54 that compensates for the change in weight due to the change in position of the on-site wheel subassembly 71 from the up-folded position of FIG. 2 to the final on-site position of FIG. 14.

METHOD

The set-up procedure descriptive of the method aspects of the invention includes the steps of (i) releasing wheel subassembly 71 relative to sub-frame 70 to allow the former, previously up-folded, to strike the earth's surface 11, (ii) activating the actuator 84 so as to cause initial downward movement of the subframe 70 and the on-site wheel subassembly 71 into contact with the earth's surface 11 as the main frame 65 is motionless followed by pivoting movement of the main frame 55 about its axis of rotation R2 with the subframe 70, as the subframe 70 and Wheel subassembly 71 are essentially motionless, (iii) attaching a chain 166 between the uplifted main frame 55 and the drive machine 13, (iv) hydrostatical deactivating the hydrostatic actuator 84 to allow the subframe 70 and on-site wheel subassembly 71 to be uplifted relative to the earth's surface 11 until the arms 86 attached to swivel wheels 93 clear the earth's surface 11, such movement being the result of attaching the chain 166 to the main frame 65 and using the latter and pivot hitch 54 as reaction supports, (v) rotating the arms 86 of the on-site wheel subassembly 71 so as to place the wheels 93 of the caster units 92 into an over center position relative to a transverse plane P4, (vi) then activating the actuator 84 to lower the swivel wheels 93 into rolling contact with the earth's surface 11 and allow the chain 166 to go slack and be removed from the main frame 55 wherein locking of the arms 86 against the truss members 72*a*, 72*b* of the subframe 70 also occurs, (vii) releasing the actuator pressure so the main frame 65 is deployed in its correct upsloped working position for trenching operations. That is, the operator adjust the height of the main frame 55 so that its remote end region 29 of the conveyor 31 is placed above the truck bed 27*a* of the dump truck 27 of FIG. 1 and the system 10 operates as shown in FIG. 1.

Figure 15:
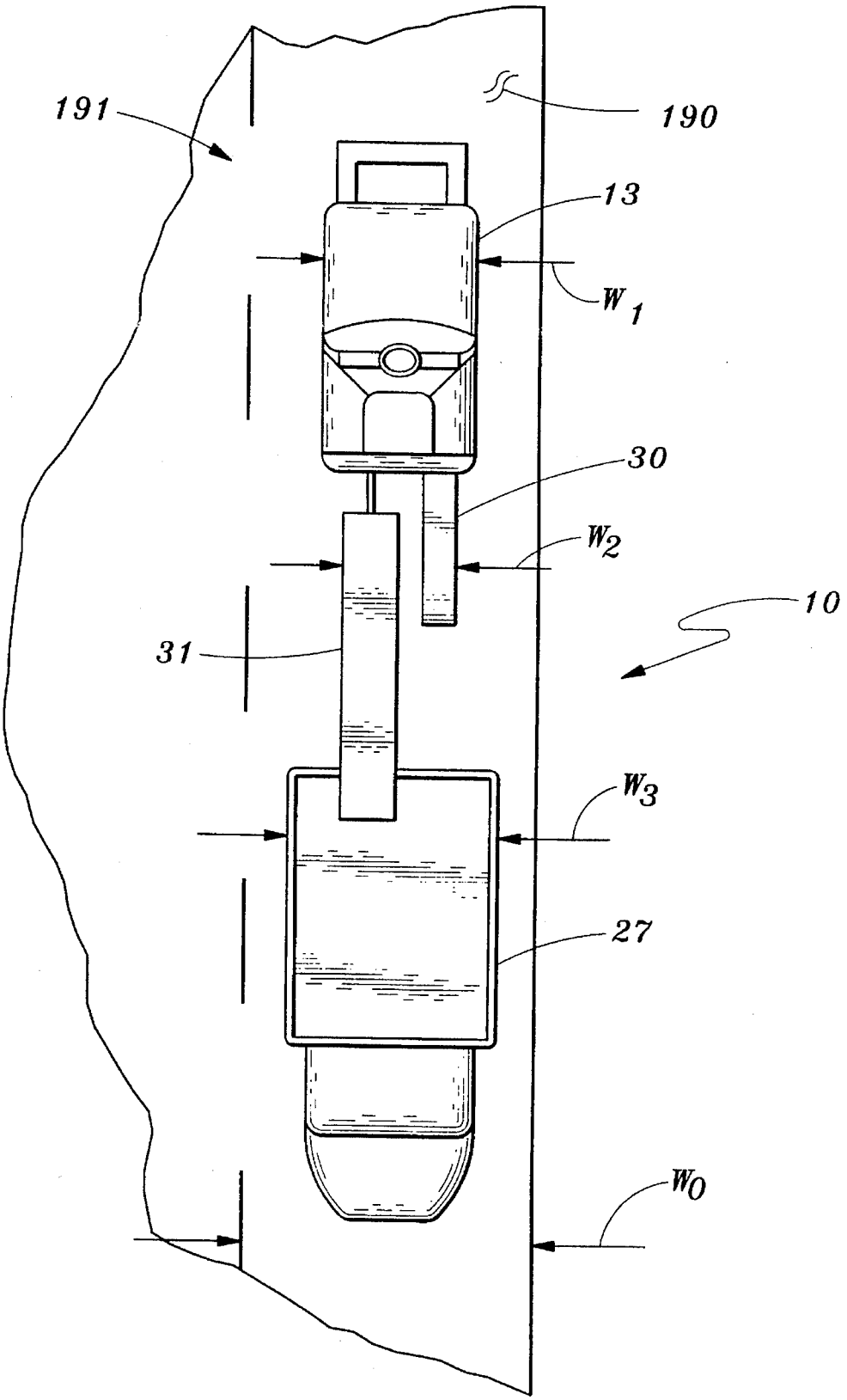
FIG. 15 is a schematic plan view of the trenching system of the invention operating on a single lane of a street.

FIG. 15 further illustrates the operations of FIG. 1 in plan view. That is, FIG. 15 is a schematic plan view of trenching system 10 of FIG. 1, in which the drive machine 13, earth saw 30, conveyer 31 and dump truck 27 are seen to be operating within a single lane 190 on paved street 191. As shown, the side-by-side conveyer 31 and earth saw 30 together defining an overall transverse width W2, while the drive machine 13 has a transverse width W1, and the dump truck 27 has an width W3. Since the single lane 190 has a transverse width Wo which is greater than each of the transverse widths W1, W2 and W3, there is minor disruption of traffic as the trenching operation by the system 10 occurs.

By the above description there is set forth a center-line trenching system adapted for use in providing a center-line groove in a paved street for laying of television cables, telephone lines and the like in which easy trailering of the conveyor to the job site and fast set-up of the conveyor after arrival, occur. In addition, operations at the job site are conveniently performed since the driving machine, earth saw, conveyor and following dump truck can be located within a single traffic lane of the street. However, since numerous changes and modifications by those skilled in the art are readily apparent from such a description without departing from its principles it is intended such modifications and changes within the scope of the invention as set forth in the following claims.

I claim:

1. A center-line trenching system for use at the earth's surface comprising a drive machine of transverse width W1 movable over the earth's surface including a rear mounting surface, a power drive train system and an fuel driven engine, a series of hydrostatic pumps operatively connected to said fuel driven engine, and control unit for controlling at least one of said series of hydrostatic pumps, a center-line earth saw attached to said rear mounting surface and operatively attached to at least one of said hydrostatic pumps, said earth saw extending from said machine and including a cutting disc having cutting protuberances circumferentially spaced about its periphery and said center-line saw being adjustable relative to said rear mounting surface for varying the cutting depth relative to said earth's surface along a first working plane normal to the said earth's surface passing through said drive machine, a shroud extending over a sector of said cutting disc fixedly mounted relative to the cutting disc and including an opening to one side of said first working plane, said shroud also including a lower segment positioned to collect debris cut from said earth formation, and convey said debris toward and from said side opening to exterior of said earth saw, a conveyer also attached to said rear mounting surface of said drive machine side-by-side relative to said earth saw to define overall transverse width W2 therewith, said conveyer defining a bisecting working plane parallel to said first working plane also passing through said drive machine and being operatively attached to at least one of said hydrostatic pumps through said control unit, said conveyer including a subframe pivotally attached relative to said rear mounting surface of said drive machine, an elongated main frame pivotally mounted to said subframe at a near end region in a upwardly ramped position relative to said near end region of said main frame, and including a trailing end region remote therefrom, a hydrostatic actuator pivotally mounted between said subframe and said main frame, and on-site wheel subassembly pivotally attached to said subframe and having a pair of swivel wheels in rolling contact with said earth's surface during an active state of said conveyor, said main frame including a pair of rubber tired wheels for trailering said conveyer to a job site but positionable above said earth's surface during said active state of said conveyor, said hydrostatic actuator being operatively attached to said at least one hydrostatic pump through said control unit to perform two functions: (i) to provide a linear force to said main frame to permit said main frame to be tilted about said near pivoting end region thereof to provide said upwardly sloped position whereby said rubber tired wheels are elevated off said earth's surface and permit relocation of said swivel wheels of said on-site wheel subassembly to provide rolling contact with said earth's surface and (ii) to relocate said trailing end region of main frame to provide a working sloped position of said main frame whereby said trailing end region of said main frame is positioned at a pre-selected height relative to said earth's surface to permit debris to be off-loaded, a rubber tired, self propelled vehicle downstream of said conveyor to collect said debris exiting therefrom, said vehicle having a transverse width W2 and including a truck bed positioned relative to said trailing end region of said main frame to catch by gravity said debris exiting therefrom.

2. The system of claim 1 in which said drive machine and said swivelable wheels of said on-site wheel subassembly are rubber tired and said earth's surface is a paved street having a single lane of transverse width Wo wherein said transverse widths W, W1 and W2 are each less than Wo.

3. The system of claim 1 with the addition of pivot hitch attached between said rear mounting surface of said drive machine and said subframe of said conveyor, and including a positionally fixed T-shaped male element depending from said rear mounting surface and a female element attached to said subframe to form a positionally fixed pivoting axis R2 therefor.

4. The system of claim 3 in which said T-shaped male element includes a base leg attached to said rear mounting surface and a pair of parallel legs positioned at a fixed elevation relative to said earth's surface to define said axis of rotation R2 between said pivot hitch and said subframe.

5. The system of claim 4 in which said female element of said pivot hitch includes a pair of U-shaped female stubs attached to said subframe, and a pair of T-shaped hangers each disconnectably connected about a U-shaped female stub wherein each of said female stubs is rotated so its open end faces inwardly towards each other, and said associated T-shaped hanger fixes over said parallel legs to form a pocket to releasably accept and confine one of said parallel legs of said T-shaped male element of said pivot hitch therein wherein said axis of rotation R2 for said subframe bisects said pockets.

6. The system of claim 3 in which said main frame of said conveyor includes a pair of rail members pivotally attached to said subframe at an axis of rotation R1 positionally adjacent to said axis of rotation R2 and parallel thereto, whereby positional movement of said hydrostatic actuator permits said main frame to be tilted about said axis of rotation R1 to: elevate said rubber tired wheels off said earth's surface, relocate said swivelable wheels of said on-site wheel subassembly into rolling contact with said earth's surface and elevate said trailing end region of main frame at a pre-selected height relative to said earth's surface to permit debris to be off-loaded, said main frame also including a forward drum pivotally attached across said rail members, a hydrostatical driven rear drum attached across said main frame adjacent to said trailing end of said main frame, and an endless belt in tangential contact about said forward and rear drums to be driven in movement therebetween.

7. The system of claim 6 in which said endless belt includes a series of transverse cleats on one side to convey said debris exiting from earth saw to said truck bed of said rubber tired, self propelled vehicle downstream thereof.

8. The system of claim 6 in which said on-site wheel subassembly also includes a pair of parallel arms cantilevered from said sub-frame and having first ends pivotally and disconnectably attached said parallel arms and opposite ends, a transverse support member attached across said parallel arms at said opposite ends, wherein said pair of swivelable wheels each have a transverse axle, and an off-center collar having a first end attached to ends of said axle and an opposite end pivotally attached to said support member to permit said each of said swivelable wheels to pivot about an swivel axis of rotation normal to said axes of rotation R1 and R2, said on-site wheel subassembly having at least two positions of operation, a first rest position occurring during said trailering state said conveyor wherein said pair of arms are folded toward said drive machine and said swivelable wheels are elevated above said earth's surface, and a first active position in which in said wheel subassembly is permitted to undergo rotation relative to said sub-frame to assume a position in which said pair of arms extend from said drive machine wherein said swivelable wheels are in rolling tangential contact with said earth's surface and thereby supporting said conveyer relative thereto wherein loading at said pivot hitch is augment by a component of weight acting through said sloped position of said main frame relative to said earth's surface.

9. The system of claim 8 in which said loading is in a range of 25 to 175 pounds at said pivot hitch.

10. A conveyor for use at the earth's surface, comprising a subframe including a pair of longitudinally extending truss members, an elongated main frame including a pair of rail members pivotally mounted at near end regions to said truss members of said subframe, and including trailing end regions remote therefrom, a hydrostatic actuator pivotally mounted between said subframe and said main frame, and on-site wheel subassembly pivotally attached to said subframe and having a pair of swivel wheels in rolling contact with said earth's surface during an active state of said conveyor and in an up-folded position well above said earth's surface during a trailering state of said conveyor, said main frame including a pair of rubber tired wheels fixedly attached to said rail members for trailering said conveyer to a job site during said trailering state of said conveyor but positionable above said earth's surface during said active state of said conveyor, said hydrostatic actuator being operatively attached to an exteriorly positioned hydrostatic pump through a control unit to perform two functions: (i) to provide a linear force to said main frame to permit said main frame to be tilted about said near pivoting ends of said rail members to a ramped position upsloped from said near end regions of said main frame wherein said rubber tired wheels are elevated off said earth's surface and permit relocation of said swivelable wheels of said on-site wheel subassembly into rolling contact with said earth's surface and (ii) in said active state to relocate said trailing end regions of said rail members of said main frame to provide a working sloped position of said main frame whereby said trailing end regions of said main frame is positioned at a pro-selected height relative to said earth's surface to permit debris to be off-loaded.

11. The conveyer of claim 10 with the addition of female element of a pivot hitch attached to said truss members of said subframe, said female element including a pair of U-shaped female stubs attached to said near end regions of said truss members of said subframe, and a pair of T-shaped hangers each disconnectably connectable about one of said pair of U-shaped female stubs wherein each of said female stubs is rotated so its open end faces inwardly, and said associated T-shaped hanger fits over said parallel legs to form a pocket to releasalby accept and confine male element of said pivot hitch to define positionally fixed axis of rotation R2 for said subframe.

12. The conveyer of claim 11 in which said truss members of said subframe includes a pair of ears having openings therethrough attached at said near ends thereof and said near end regions of said rail members of said main frame includes openings in transverse alignment with said openings of said pair of ears and a cross bar extending through said aligned openings to permit said main frame to pivot relative to said subframe to establish an axis of rotation R1 relative thereto, said axis of rotation R1 being parallel to said axis of rotation R2.

13. The conveyor of claim 10 in which said hydrostatic actuator includes a cylinder pivotally attached adjacent to said remote end regions of said truss members of said subframe and a piston pivotally attached to main frame whereby positional movement of said piston permits said main frame to be tilted about said axis of rotation R1 to: elevate said rubber tired wheels off said earth's surface to form an upsloped ramped position for said main frame relative to said near end regions thereof, relocate said swivelable wheels of said on-site wheel subassembly into rolling contact with said earth's surface and relocate said trailing end regions of main frame to provide said working sloped position of said main frame whereby said trailing end regions of said main frame is positioned at a pre-selected height relative to said earth's surface to permit debris to be off-loaded, said main frame also including a forward drum pivotally attached across said rail members, a hydrostatical driven rear drum attached across said main frame adjacent to said trailing end of said rail members of said main frame, and an endless belt in tangential contact about said forward and rear drums to be driven in movement therebetween.

14. The conveyor of claim 13 in which said endless belt includes a series of transverse cleats on one side to convey said debris therealong.

15. The conveyor of claim 10 in which said on-site wheel subassembly also includes a pair of parallel arms cantilevered from said sub-frame and having first ends pivotally and disconnectably attached said parallel arms and opposite ends, a transverse support member attached across said parallel arms at said opposite ends, wherein said pair of swivelable wheels each have a transverse axle, and an off-center collar having a first end attached to ends of said axle and an opposite end pivotally attached to said support member to permit said each of said swivelable wheels to pivot about an swivel axis of rotation normal to said earth's surface, said on-site wheel subassembly having at least two positions of operation, a first rest position occurring during trailering of said conveyor to said job site wherein said pair of arms are up-folded relative to said truss members of said subframe wherein said swivelable wheels are elevated above said earth's surface, and a first active position in which in said wheel subassembly is permitted to undergo rotation relative to said sub-frame to assume a position in which said pair of arms extend into contact with said earth's surface wherein said swivelable wheels are in rolling tangential contact with said earth's surface and thereby supporting said conveyer relative thereto.

16. The conveyor of claim 15 with the addition of a hitch attached to said trailing ends of said rail members of said main frame for trailering said conveyor to a job site using said trailer wheels in rolling contact with said earth's surface and said pair of arms of said on-site wheel :subassembly is up-folded relative to said truss members of said subframe.

17. The conveyor of claim 16 in which said truss members of said subframe are in broad longitudinal contact with said rail members of said main frame during said trailering state of said conveyor to said job site wherein said main frame and said subframe are horizontal to said earth's surface to define a center of gravity near said trailing wheels wherein loading at said hitch is low, say in a range of 50 to 150 pounds.

18. The conveyor of claim 15 with the addition of a male element attached to said female element of said pivot hitch to permit said conveyor to be conveyed in a forward direction relative to said earth's surface and said swivelable wheels are in said active state in contact with said earth's surface and said main frame is elevated in said sloped working position wherein loading at said pivot hitch is augment by a component of weight acting through said sloped main frame thereon.

19. The conveyor of claim 18 in which said loading is in a range of 25 to 150 pounds at said pivot hitch.

20. Method of setting up a conveyor at the earth's surface wherein said conveyer is to be attached to a drive machine of transverse width W1 in a side-by-side position relative to a center-line earth saw also attachable to said drive machine to define overall transverse width W2 therewith, said conveyor including a subframe, a main frame pivotally attached to subframe, a on-site wheel subassembly including a pair of swivel wheels pivotally attached relative to said subframe, and hydrostatic actuator pivotally coupled between said subframe and said main frame, comprising the steps of:

(i) attaching a male element of a pivot hitch between the drive machine and a female element fixed attached to said subframe to define a elevationally fixed axis of rotation R2 therefor, (ii) activating the hydrostatic actuator to provide the main frame with an upsloped position relative to its near end, (iii) attaching a chain between the main frame and the drive machine to rigidize the upsloped position of the main frame, (iv) deactivating the hydrostatic actuator to position the subframe and hydrostatic actuator in an upsloped position relative to the pivot hitch to permit swivel wheels of the on-site wheel subassembly previously held in an up-position to be rotated into contact with the earth's surface, (v) activating the hydrostatic actuator to lock the swivel wheels relative to subframe and to cause the chain to slacken and permit its removal from said main frame, (vi) reorienting the main frame to a working slope position wherein the trailing end of the main frame is a pre-selected height to permit debris to be off-loaded from the main frame.

21. The method of claim 20 with the addition of precursor steps of (a) trailering the conveyor using a trailer hitch attached between the trailing end of the main frame and a rubber-tired self propelling trailering vehicle to the job site using a pair of rubber tired trailering wheels fixedly attached to said main frame wherein the swivel wheels of the on-site wheel subassembly are disconnectably connected in a position above the earth's surface, (b) backing the conveyor so that the near end of the subframe opposite the trailer hitch is adjacent to the drive machine and wherein the conveyor is side-by-side to the earth saw and trailer hitch is easily decoupled from the trailering vehicle.

22. The method of claim 20 in which step (vi) includes adjusting the height of the main frame so that the trailing end of the main frame is above the truck bed of a self-propelling vehicle downstream of the conveyor, earth saw and drive machine.

23. The method of claim 22 in which step (vi) also includes hydrostatically activating an endless belt supported on said main frame to convey the debris exiting from the earth saw to the trailing end of the main frame and thence to the truck bed of the self-propelling vehicle.

* * * * *